US009489808B1

(12) United States Patent
Wang et al.

(10) Patent No.: US 9,489,808 B1
(45) Date of Patent: Nov. 8, 2016

(54) ELECTRICAL DEVICE AND METHODS OF MAKING AND USING THE DEVICE

(71) Applicant: Lin Wang, Hangzhou (CN)

(72) Inventors: Lin Wang, Hangzhou (CN); Peter Morello, Sr., Stuart, FL (US)

(73) Assignee: HANGZHOU TIMING SECURITY TECHNOLOGIES, CO., LTD., Hangzhou (CN)

( * ) Notice: Subject to any disclaimer, the term of this patent is extended or adjusted under 35 U.S.C. 154(b) by 0 days.

(21) Appl. No.: 14/929,721

(22) Filed: Nov. 2, 2015

(51) Int. Cl.
*G08B 13/14* (2006.01)
*G08B 3/10* (2006.01)
*G08B 13/00* (2006.01)

(52) U.S. Cl.
CPC ..... *G08B 3/10* (2013.01); *G08B 13/00* (2013.01)

(58) Field of Classification Search
CPC ..... G08B 13/00; G08B 13/02; G08B 13/06; G08B 13/12; G08B 13/14; G08B 13/1409; G08B 13/1445; G08B 13/1463; G08B 13/22; A45C 13/18; A47F 5/0861
USPC ..... 340/568.1–568.8
See application file for complete search history.

(56) References Cited

U.S. PATENT DOCUMENTS 6,621,415 B1 * 9/2003 Willis ..... G08B 13/1463 340/568.1
7,212,115 B1 * 5/2007 Fawcett ..... G08B 13/1445 340/545.6
2007/0146134 A1 * 6/2007 Belden ..... G08B 13/1445 340/571
2007/0164860 A1 * 7/2007 Marsilio ..... G08B 13/1463 340/568.4
2008/0122579 A1 * 5/2008 German ..... H01R 13/6683 340/10.1
2012/0019383 A1 * 1/2012 Fawcett ..... G08B 13/1463 340/568.1
2012/0229975 A1 * 9/2012 Yang ..... B65D 63/14 361/679.57
2013/0241731 A1 * 9/2013 Fawcett ..... G08B 13/1463 340/568.2

OTHER PUBLICATIONS

Hangzhou Timing Security Technologies Co., LTD. "Timing Catalog" pp. 1-36. China.

* cited by examiner

*Primary Examiner* — Brian Wilson
(74) *Attorney, Agent, or Firm* — Peter K. Trzyna, Esq.

(57) ABSTRACT

An electrical device, processes for using and making the device, and products produced thereby. There can be an alarm device and an extension which includes a protrusion. The extension can have wiring, and the alarm device can detect for a change in electricity running through the wiring, such as a change that would occur when the electricity is interrupted when the wiring is cut. The protrusion is located adjacent to the extension, distant from the alarm device, and can include a key, switch, connector, or the like. The protrusion, in some cases, can be releasably connectable to a housing that is in turn connected to the extension, so as to form a loop in which an item can be secured for protection, e.g., from theft.

20 Claims, 6 Drawing Sheets

IC Program Detail:

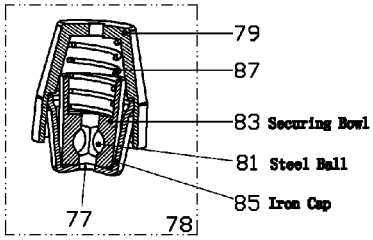
Fig 8
Fig 9
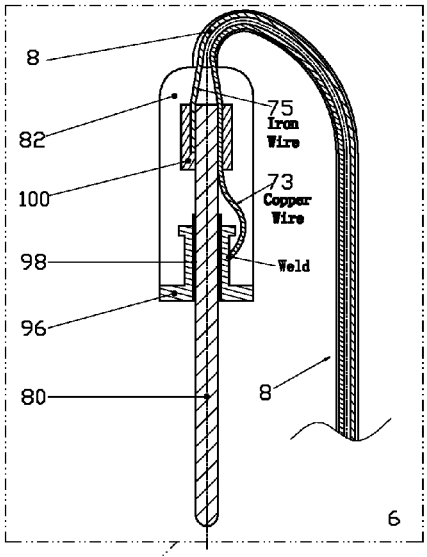
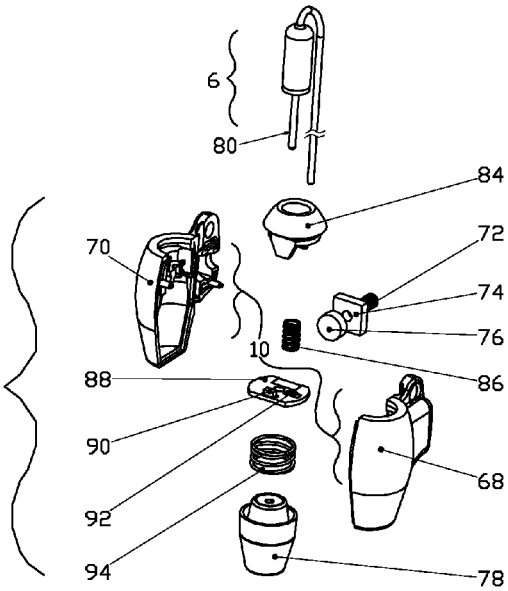
Fig 7
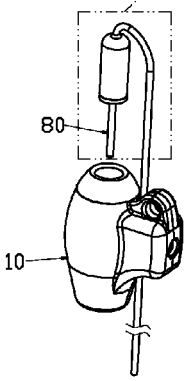
Fig 10
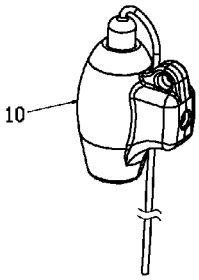
Fig 11

ELECTRICAL DEVICE AND METHODS OF MAKING AND USING THE DEVICE

The following relates to articles of manufacture, electrical apparatuses, and processes of using and making them, as well as the products produced by the process of making them.

I. BRIEF DESCRIPTION OF THE FIGURES

Figure 1:
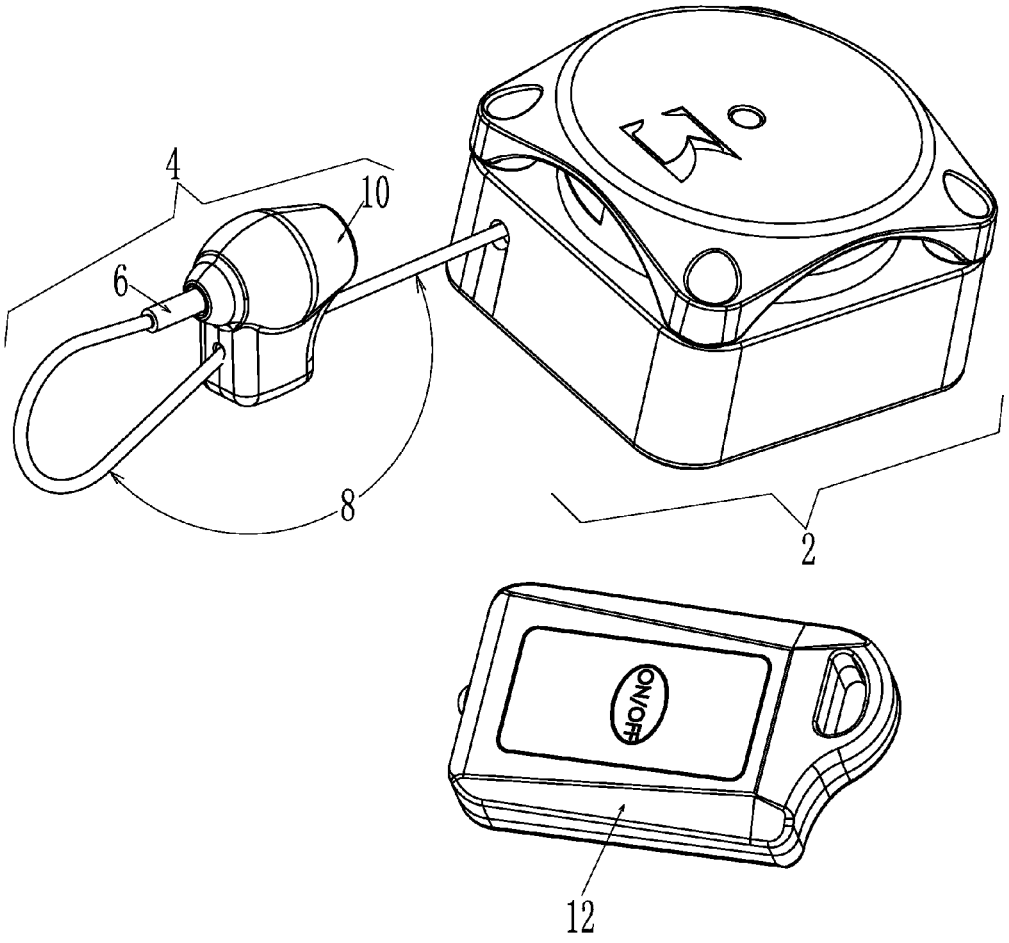
Figure 2:
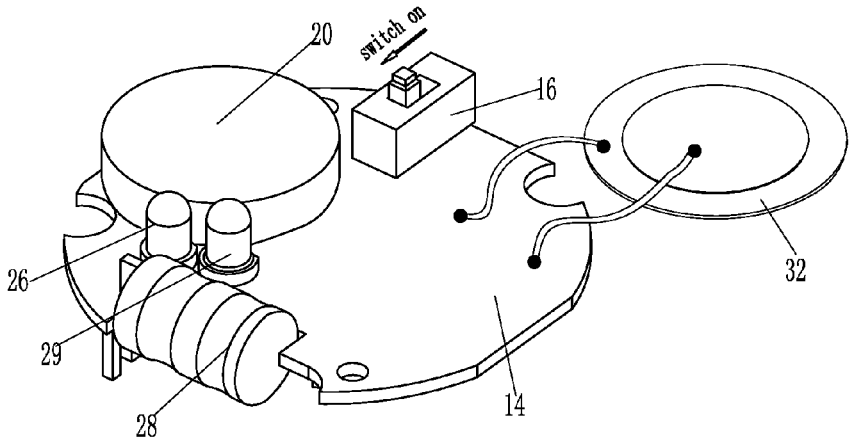
Figure 3:
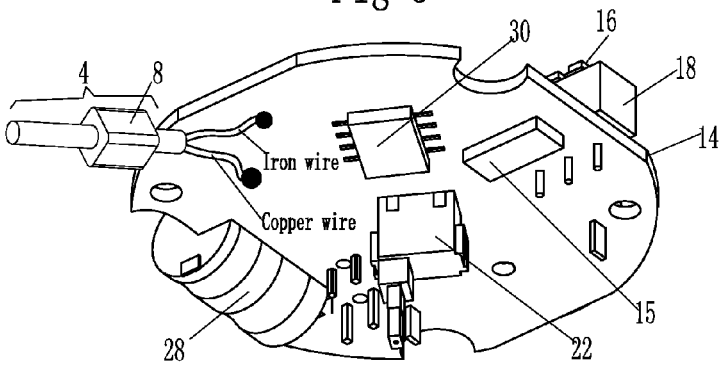
Figure 4:
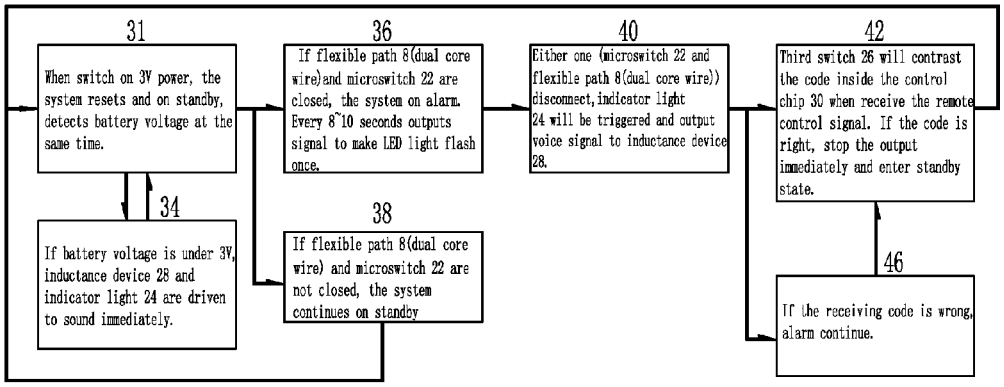
Figure 5:
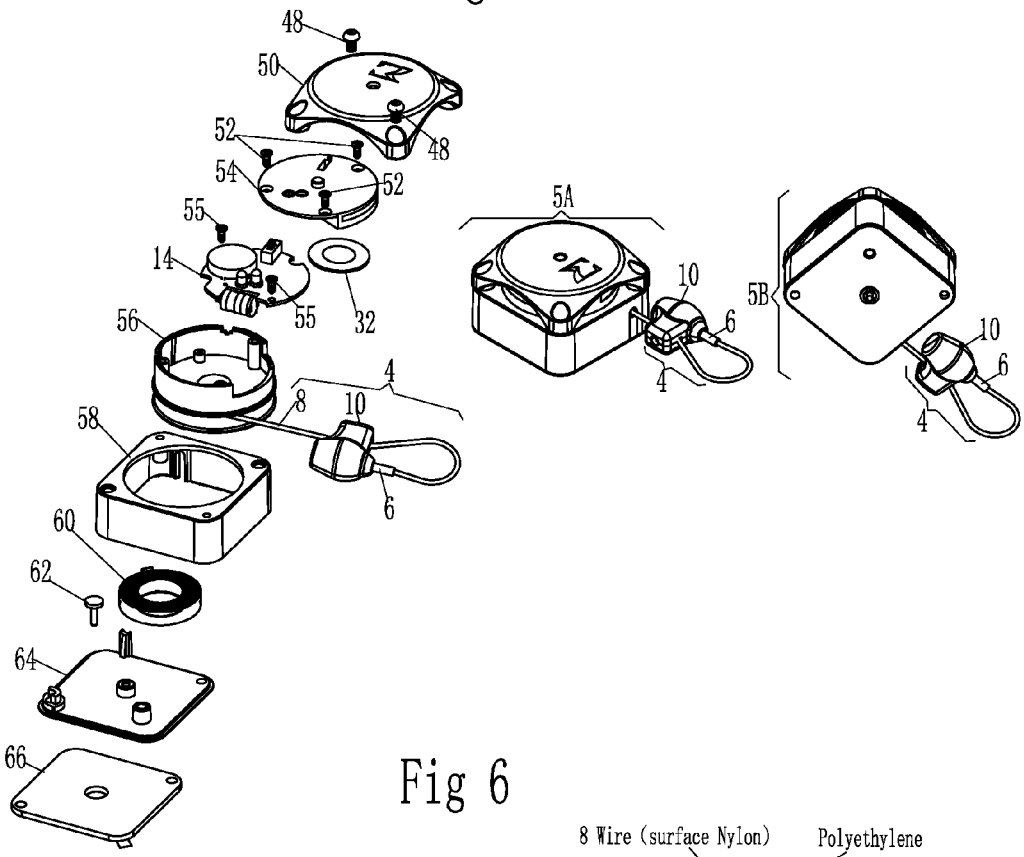
Figure 6:
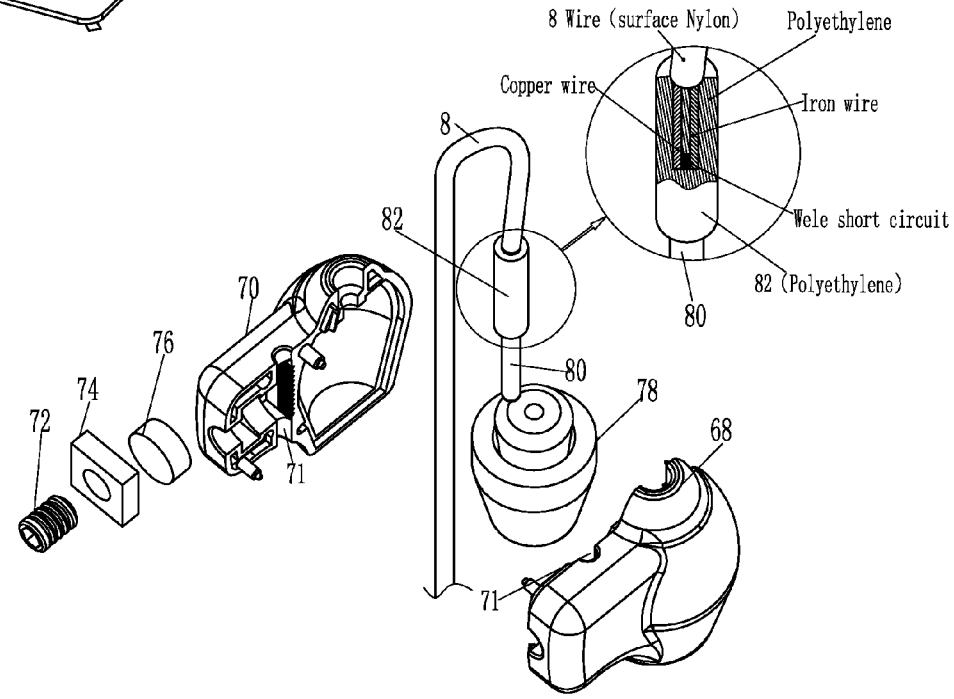
Figure 12:
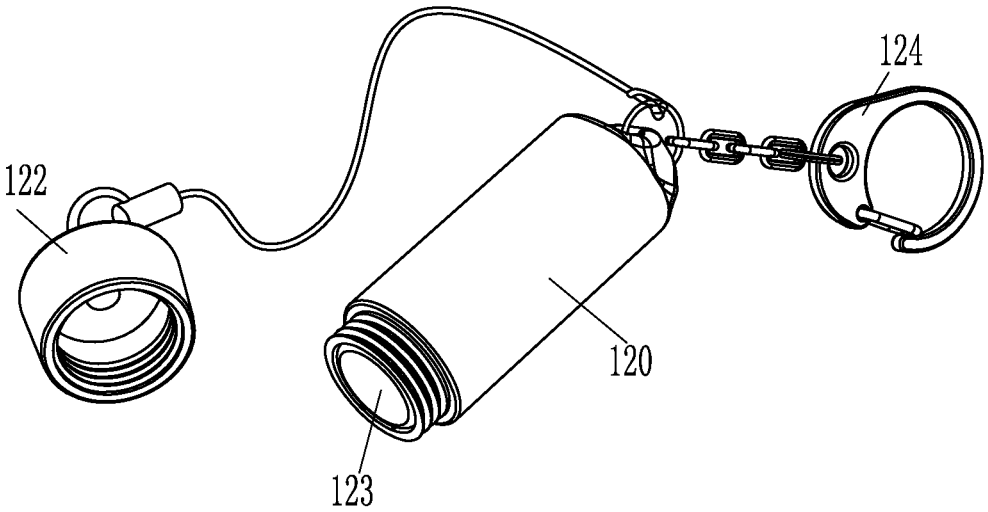
Figure 13:
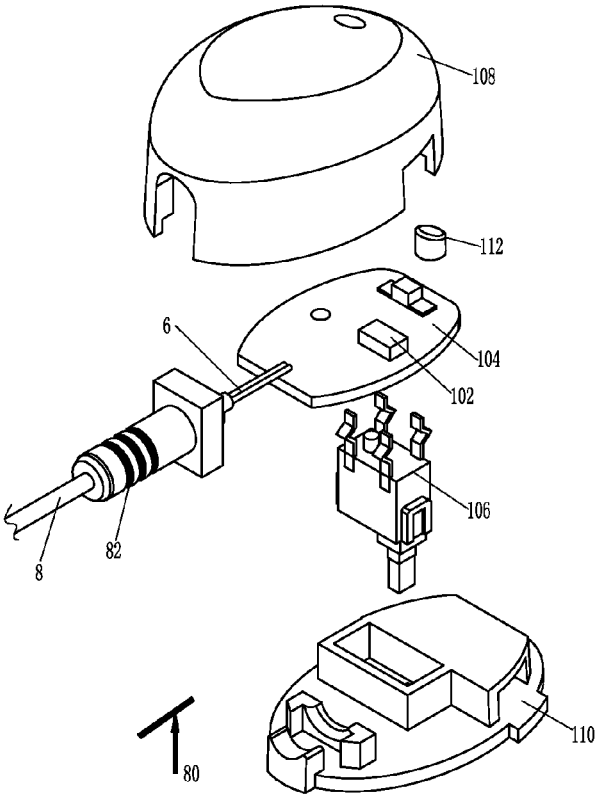
Figure 14:
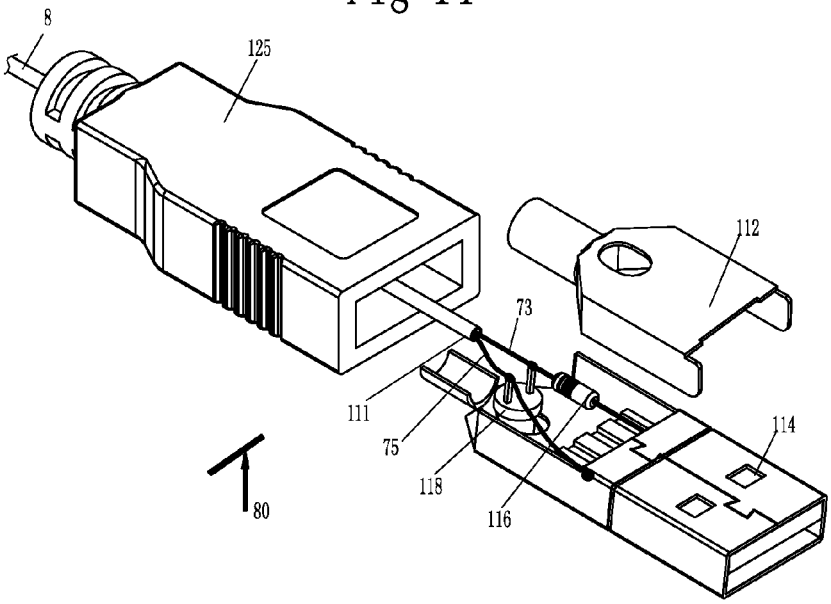

FIG. 1 shows a perspective overview for embodiments.
FIG. 2 shows an upper-side view for embodiments.
FIG. 3 shows an under-side view for embodiments.
FIG. 4 shows a logic flow diagram.
FIG. 5 shows an alarm device, with upper side 5A and lower side 2B.
FIG. 6 shows a housing.
FIG. 7 shows another housing.
FIG. 8 shows a lock.
FIG. 9 shows a protrusion.
FIG. 10 shows a view of a protrusion not inserted in a housing.
FIG. 11 shows another view of a protrusion inserted in a housing.
FIG. 12 shows a magnetic key for embodiments.
FIG. 13 shows another protrusion for embodiments.
FIG. 14 shows yet another protrusion.

II. DETAILED DISCLOSURE OF EMBODIMENTS

Generally, an alarm apparatus can include an alarm device and an extension which includes a protrusion. The extension can have wiring, and the alarm device can detect for a change in electricity running through the wiring. For example, the alarm device can detect for a change that would occur when the electricity is interrupted, such as when the wiring is cut. The protrusion is located adjacent to the extension, distant from the alarm device, and can include a key, switch, connector, or the like.

The protrusion, in some cases, can be releasably connectable to a housing that is in turn connected to the extension, so as to form a loop in which an item can be secured for protection, e.g., from theft. For example, if the item to be protected is a purse connected with a handle (strap, ring, or other device with a hole as part of it), the purse handle can be lassoed by a loop formed essentially by the housing and the extension, in some cases also including the extension's protrusion.

The alarm device can include a first switch having ON and OFF positions, and a second switch having ON and OFF positions. The first switch can be used to turn the alarm ON or activate the alarm, and in some cases, turn the alarm OFF or deactivate the alarm. The second switch can, for example, be a spring-loaded switch located on the alarm device so that the switch is triggered OFF when the alarm device is separated from a surface to which the alarm device is adhered or mounted, e.g., the switch thereby interrupting the electricity. In some, but not all cases, there can be a third switch, e.g., receptive to a remote control, to turn OFF an alarm of the alarm device or turn the alarm device to a standby mode. The alarm can be one or more of a buzzer, light, bell, broadcast, etc. An electrical interrupt can be a switch, a plug, etc., which when disconnected interrupts the flow of electricity, etc.

Circuitry unites cooperation of the switches employed in the embodiment of interest (illustratively here, the first, second, and the third switches) and the alarm. The alarm device (which may be battery powered) can be activated when the first switch is ON and the second switch is located in a retracted, ON position; the alarm is triggered when the circuitry detects an electrical change in the path of the extension or when the second switch is relocated in an extended, OFF position; and the alarm is deactivated by the third switch, which if so desired, can be responsive to receipt of a broadcast code from the remote control and/or by location of the first switch to OFF.

In some implementations, the alarm device can be structured so that the protrusion is a key which unlocks the first switch to the ON position. In some but not all cases, the key is releasably connectable to the housing by a lock, such as a magnetic lock having a magnetic key. If so preferred, there can be a fourth switch operable to trigger into an OFF position, to interrupt electricity in the wiring, if the protrusion's key is removed from the housing without using the lock key. Various embodiments of the alarm device can be implemented as may be preferred in one application or another. See generally, FIG. 1.

Additionally, there can be a process for manufacturing that includes making a standardized alarm device in quantity, and making quantities of different types of extensions, and combining a portion of the standardized alarm devices with one of the types of extensions and another portion of the standardized alarm devices with another of the types of extensions, to form different types of articles of manufacture, related by the commonality of the standardized alarm device. In such a process, the standardized alarm devices have essentially identical hardware, but different types of extensions. Or in some cases, there can be an accommodation of the different types of extensions, but still use the same detecting of an electrical interruption or change in state by the standardized alarm devices.

So for example, one type of extension might employ one of the above-mentioned wiring, housing, and key embodiments (e.g., FIG. 1); another extension might employ wiring connect to an electrical USB, or a MINIUSB plug (as the protrusion) and detect for the interruption in electricity that would occur when the plug is disconnected from a computer or other such electrical device or source (e.g., FIG. 14); yet another extension might employ an additional switch (as the protrusion) that interrupts electricity when the item to be protected is separated from the additional switch, e.g., separating a perfume bottle from the adhesively-attached additional switch (e.g., FIG. 13); and so forth. Yet these extensions can all utilize essentially the same, standardized alarm device.

Many of the implementations flow from the teachings and principles disclosed herein. Though discussed herein is in the context of an electrical path, it should be understood that the path can instead be a light path (e.g., the extension being a light tube or the like) with the detecting including detecting a change or interruption in the light in the path of light. Thus, depending on the context herein, it should be understood that an electrical interrupt illustratively encompasses a disclosure of refers to a light or other energy interrupt. Also, while discussions herein mention resistance, conductivity can of course be used (i.e., resistance is the reciprocal of conductivity). Depending on the context, negative logic, i.e., testing for ON instead of OFF, power rather than no power, etc., can also be employed, and analog, digital, or a combination thereof are suitable for implementations consistent with the teachings herein.

Turn now more particularly to FIG. 1 which provides an overview, in perspective, illustrative some but not all embodiments of an alarm apparatus. In this overview, there is an alarm device 2 that is associated with an extension 4, which in this case, includes a protrusion 6 adjacent to a flexible, electrical path 8. The extension 4 can, for example, be comprised of a dual core wire 3 (such as Iron and Copper) defining the path 8. As illustrated in FIG. 1, the protrusion 6 can be inserted into a housing 10 to form a looping portion of path 8 in connection with the housing 10. Also shown in FIG. 1, there can in some cases be a remote control 12, which is operable to turn the alarm device 2 OFF or into a standby mode, depending on the implementation of interest. In some embodiments, remote control 12 is operable in whole or part to turn the alarm device 2 ON and/or into an activated mode. Such IR remote controls are used in television and cable box switching, and suppliers include Sharp™, LG™, Samsung™ and Comcast™, and ATT™ digital.

FIG. 2 and FIG. 3 collectively illustrate embodiments implemented with circuitry 14 that can, but need not, comprise a printed circuit board having elements on both sides. Upon the printed circuit board circuitry 14 can be a first switch 16, having ON and OFF positions. If so desired, the first switch 16 can be disposed so that movement of a switch 16 position to a position more central to the circuit board 14 will turn the power ON for the alarm device 2. In some cases, there can be a portal 18 located and structured to receive and guide the protrusion 6 to dispose the first switch 16 from OFF to ON. Power can be provided by a battery 20 or otherwise. For example, the battery 20 can be a 1623 battery with a weld leg, which can be used with diode 15 to sturdy the voltage of battery 20. Further, there can be a second switch 22, for example a micro switch, operable by a spring-loaded plunger to have an extended OFF position and a retracted ON position. The extended position can reach farther outwards from an exterior surface (See bottom cap 64 in FIG. 5) of the alarm device 2 than the retracted position.

If so desired, the printed circuit board circuitry 14 can cooperate with an indicator light 24 (e.g., an LED) which illuminates, e.g., periodically, when the power is ON. Also, if so desired, there can be a third switch 26, such as receiver operable to receive a broadcast signal from remote control 12, to turn the alarm device 2 OFF or to a standby mode. Remote control 12 can, if so desired, broadcast an infrared code to which the receiver/switch 26 is receptive for controlling its switching. Such remote controls and receivers are commonly commercially available.

Alarm device 2 can have an inductance device 28. Such devices are commonly available and sometimes known as an "audio push switch adapter." An audio push switch adapter has two different-diameter copper coils and a magnetic bar/ferrite rod. These cooperate so that when a control chip 30 (discussed below) sends out a small, pulsing signal, the inductance device 28 transfers the small signal from the control chip 30 into a large signal which drives an alarm 32, e.g., a buzzer wafer, also known as a piezoelectric wafer (e.g., 20 mm), which then produces an alarm sound. Other alarms can be used, e.g., a bell, light, broadcast, indicator, etc.

The printed circuit board circuitry 14 can include the control chip 30, which can be a small IC control chip. Chip logic can be hard wired or implemented with a CPU (e.g., for a computer) and programmable logic or a combination thereof. The chip 30 can be a HS 173NS08-J (available from Shenzhen Bofutong Technology Co., ltd.) or the like.

Program logic can, but need not, be such as in FIG. 4, such that when power (e.g., 3 volts) is turned ON for the control chip 30, in block 31, the logic resets and, in a standby mode, detects to test battery voltage. In block 34, if the voltage is under a threshold, e.g., 3 volts, then inductance device 28 and alarm 32 are triggered into an alarm mode, e.g., driven to sound the buzzing alarm. Blocks 36 and 38 also test for voltage. In block 36, if the second switch 22 is ON and the power is ON in the path 8, then alarm device 2 is in an activated mode. Control chip 30 outputs a signal to make the indicator light 24 illuminate, and if desired, illuminate again every 8-10 seconds while in the activated mode. However, in block 38, if the second switch 22 is not ON and/or there is not power in the path 8, then the logic remains in standby mode, returning to block 32. When the alarm device 2 is activated in block 36, block 40 tests for a change in state, such as the second switch 22 being changed to OFF and/or there being no power in the path 8. If there is a change in state, then inductance device 28 and alarm 32 are driven to trigger the alarm 32, e.g., buzzing, and if so desired, trigger another alarm indication such as having the indicator light 24 illuminate constantly, (or pulsate multiple times per second, depending on the preferred implementation) etc. Block 42 tests for a broadcast, such as a code, from remote control 12. If the code is recognized by the third switch 26, then the alarm 32 is no longer triggered, e.g., the buzzing of alarm 32 and constant illumination of the illumination indicator 24 will cease. Thusly, the logic from the alarm mode leads to the standby mode and block 32. In block 46, if the code is not received and recognized, then the alarm 32 remains triggered, and such as the buzzing and illumination will continue.

Using the alarm apparatus can commence by turning the first switch 16 ON and pressing the second switch 22 to activate the alarm device 2 into the logic in FIG. 4. In a stabilized, activated mode, if so desired, the indicator light 24 can flash one time, and then periodically, e.g., each 8.8 seconds. The process can include detecting, by the control chip 30, both ends (e.g., the Iron and Copper wires) of the dual core wiring of path 8 of extension 4 in real time, and detecting whether the second switch 22 is ON: if the control chip 30 detects that resistance in the path 8 is weaker or stronger than expected, or if the second switch 22 is OFF (interrupting the power), then the process includes sending, by control chip 30, a signal to the inductance device 28 which makes the alarm 32 buzz or otherwise indicate that the alarm has been triggered. Stopping the alarm 32 from buzzing, by changing alarm device 2 OFF or to a standby mode, can be carried out by sending a broadcast signal from the remote control 12 and receiving the broadcast signal by the third switch 26, which is detected by the control chip 30 to cease the alarm 32's buzzing. Alternatively or combinatively, switch 16 can be disposed to the OFF position.

In sum, the circuitry 14 of alarm device 2 can be configured to detect a change in state, such as an electrical interrupt, which may be produced in different ways, including when the battery 20 is weak. The electrical interrupt can also be produced by any of a short circuit, weak indication of resistance, a strong indication of resistance, the wiring being cut, and power otherwise being terminated in path 8, whereupon any form of alarm can be turned ON.

FIG. 5 illustrates a manner of making an alarm device 2, which can be a standardized alarm device 2 for operable combination with different extensions 4 and protrusions 6, as discussed below. Continuing on with the illustration from FIG. 1 to FIG. 5, there can be (e.g., two) anti-theft sunk screws 48 insertable through cover 50, which can be plastic, to encase (e.g., three) cross sunk, self-tapping screws 52. Self-tapping screws 52 are insertable into an acoustic platform 54 to which alarm 32 is attached. There can be (e.g., two) screws 55 to mount printed circuit board circuitry 14 to a pulley 56. Platform 54 is mounted by its screws 52 to the pulley 56 so as to encase circuitry 14. Pulley 56 is attached to extension 4, leading on to the protrusion 6 shown as inserted into housing 10. A shell 58, located above the platform 54, is attached to the cover 50 by the screws 48. Openings can be provided through alarm device 2 to more fixedly attach the alarm device than by just relying on adhesive means. Spring 60 is located to dispose the pulley 56 to a retracted position and is mounted to thimble 62, which can be made of Copper and serve as an axle for pulley 56. Thimble 62 rests in bottom cap 64 to which an adhesive sticker 66 is adhered. Adhesive sticker 66 can have a tabbed cover that is removed to expose an adhesive face which can be employed to bottom cap 64 to adhere alarm device 2 to a surface.

One end of the path 8 wire extends via the pulley 56 to be soldered or welded such that each of the wires 73 and 75 (see, e.g., FIG. 9) of path 8 are electrically connected to the printed circuit board 14. Board 14 is fixed on the pulley 56, which is encased by shell 58, and one end of the spring 60 is fixed to the thimble 62 axle and another end is fixed to the 56 pulley to dispose the pulley 56 to a spring-retracted position. See FIG. 5A for a perspective, top view, and FIG. 5B for a perspective, bottom view of the assembling as per FIG. 5.

If so desired, there can be another adhesive sticker located to cover portal 18 until pierced by protrusion 6 to indicate that the first use of the device 2 has not been made subject to tampering. There can be printing on this other sticker indicative of the location to be pierced by protrusion 6 to dispose first switch 16 to an ON position. For example, this other sticker can have dot indicative of the location for the piercing, and if desired, any or all of the following: one or more arrows pointing to the dot; printing the dot in color other than the color of the pulley 56, such as red for a white pulley 56; and wording such as "PIN IN." Note that for security, protrusion 6 can be configured as a key having a blade or the like that requires rotation in a keyway to enable/disable the first switch 16.

Some embodiments can require removal of cover 50 to dispose the first switch 16 to the OFF position, and another approach is to configure cover 5 to have an opening structured to allow protrusion 6 to dispose the switch to the OFF position. For tamper protection, this removal can be implemented with a special screw driver, i.e., not a slotted or cross type, but for example, an external, cruciform, Roberson, hexalobular, tap, double square, or tamper-resistant type to match with screws 48 and/or 52.

FIG. 6 illustrates one of the many ways to implement a housing 10. There can be a right shell 68 and a left shell 70 which can be joined by glue or welding or the like to contact the path 8, for example, to allow the path 8 to slidably move in a pathway 71. In such a configuration, a screw 72, such as a hexagonal screw, can be used in connection with a nut 74, such as a square nut, to adjustable screw tighten and untighten the housing 10's contact with path 8 by movement against a magnet 76. Where the path 8 has magnetic properties, use of a magnet 76 also helps prevent undue looseness of path 8 when housing 10 is not tightened against the path 8. Housing 10 also has a lock 78 (See FIG. 8), such as a cylinder lock, for releasably securing protrusion 6. If so desired, protrusion 6 be configured as key 80, such as a pin, extending from a cover column 82. Note that for security, key 80 can otherwise be a key having a blade or the like that requires rotation in a keyway in the lock 78 mechanism. The path 8 can have two branches, a Copper branch 73 (e.g., a Copper-core wire 1.2 mm diameter) and an Iron wire branch 75 (e.g., 105 mm long). In some but not all embodiments, key 80 can complete the circuit of the path 8 by having the branches join in the key 80, e.g., by welding, soldering, or otherwise. Thus, when the key 80 is held within the lock 78, interrupting the flow of power in pathway 8 would involve cutting the path 8 or destroying the lock 78, thereby triggering alarm 32.

To use such an embodiment, when alarm device 2 is activated, the process can include detecting, by the alarm device 2, the resistance on the path 8: if the resistance increases, or if the path 8 is shorted or cut (interrupted), or power surges, then the process includes triggering the alarm device 2 to have the alarm 32 sound.

Various embodiments can use protrusion 6 and housing 10 to provide a variety of extensions 4. To illustrate, consider FIGS. 7-14. In FIG. 7, protrusion 6 is structured such that key 80 is a pin. Housing 10 can have a cover 84, e.g., a transparent cover, at an end of the right shell 68 and left shell 70, which can be joined by glue, welding, screw, etc. FIG. 7 shows the screw 72, nut 74, magnet 76, and lock 78, along with spring 86. Spring 86 assists in the releasing of the pin key 80 once the lock 78 is unlocked. Spring 86 is located above board 88, which can, but need not, be a printed circuit board having an illumination indicator 90 (e.g., an LED) controlled by a chip 92. Spring 86 also can transfer signals from conductive ring 96 (FIG. 9) to circuit board or chip 92. Similarly, conductive spring 94 is located above cylinder lock 78, which is illustrated in greater detail in FIG. 8. Conductive spring 94 can transfer signals from key 80 to the board or chip 92 to ensure a complete circuit between key 80 and conductive ring 96 (FIG. 9).

FIG. 8 illustrates lock 78 in detail. Lock 78 is known as a clutch lock which works like a clutch in a car when it is pushed or released by some force, in this case a magnet 123 (FIG. 12) is release the pin key 80. Companies providing locks such as lock 78 include TYCO™ (Sensormatic Hard tags), Check Point™ (Alpha Products), Invue CO™, and Oumeisheng Electronic Co., Ltd.™. When the key 80 is inserted into opening 77, key 80 will lodge between steel balls 81 to lock firmly there between. When a magnetic key 123 (FIG. 12) is applied to the side 79 of the lock 78 having a securing bowl 83, the magnetic influence of key 123 will draw the spring 87 toward the magnet 123, allowing repositioning of the steel balls 81 so that pin key 80 is released.

Turning now to FIG. 9, illustratively teaching that key 80 is a pin, the key (pin) 80 can extend from a conductive ring 96, pass within an insulation layer 98, and extend to Copper securing layer 100, within cover column 82. Path 8, e.g. a dual core which includes Copper branch 73 and an Iron branch 75, can be connected so that the Iron branch 75 is in electrical communication with the Copper securing layer 100 but not with the conductive ring 96, whereas the Copper branch 73 is in electrical communication with the conductive ring 96 but not with the Copper securing layer 100 or the Iron branch 75, except with the key 80 in lock 78, as follows. Accordingly, when the key 80 is inserted in lock 78, conductive ring 96 will electrically communicate to the board 88 by the spring 86, while key 80 electrically communicates to board 88 by spring 94 to housing 10, thereby completing the circuit.

When the protrusion 6 and housing 10 (illustrated in FIG. 10) are manipulated so that key 80 is inserted into housing 10 (illustrated in FIG. 11) so that the (pin) key 80 is locked into the lock 78 within housing 10, the path 8 extends to the circuit board 88, which in turn communicates the power to the illumination indicator 90 and the chip 92, and thereby completing the electrical path of path 8. Thus, when the alarm device 2 is activated, removal of the key 80 from the lock 78 will interrupt the power on the path 8, triggering the alarm 32, e.g., to buzz.

In embodiments utilizing a magnetic lock 78, a magnetic key magnet 123 (see, e.g., FIG. 12) can be used to unlock the protrusion 6 from the housing 10 and lock 78. As illustrated in FIG. 12, the magnet 123, can be within a container 120 having a cap 122 that, when joined together (e.g., by screwing then together), provide magnetic insulation to prevent unintended unlocking of lock 78. If so desired, the container 120 and cap 122 can be connected, e.g., by a string or the like, and they can be structured to enable secure possession by only an individual authorized to unlock lock 78, e.g., by having at least one of the container 120 and the cap 122 mounted to a keychain 124. Other magnetic locks are also available and suitable, depending on the implementation of interest.

In operation, there can be a process of detecting, by alarm device 2, for a charge in state, such as a change in resistance, a short circuit, a surge, etc. If an embodiment such as is illustrated in FIGS. 7-11 is employed, the process can also include sending, by alarm device 2, a signal on the path 8 to the light 90 to flash an indication that alarm device 2 is activated. When a magnet 123 opens the lock 78, the process includes disconnecting the conducting ring 92 from conductive spring 88. At the time when pin key 80 disconnects from cylinder lock 78 in an armed state, the process can include interrupting the power in path 8, causing the alarm device 2 to sound the alarm 32.

Illustrative of yet another embodiment of protrusion 6 and thus extension 4 is depicted in FIG. 13. FIG. 13 shows path 8 having protrusion 6 powering a circuit board 102 which controls light 104 (e.g., an LED). Circuit board 102 is in communication with switch 106, such as a spring-loaded microswitch. Switch 106 can be adhered, mounted, or located adjacent to an article to be protected (not shown), thereby depressing switch 106 to the ON position. There can be a top cap 108 connectable to a bottom cap 110. If so desired, a light pipe 112 can communicate illumination from the light 104 to the exterior of the top cap 108. FIG. 13 illustrates that key 80 need not always be connected to extension 4.

In using this embodiment, a process can include depressing switch 106 to complete the electrical flow in path 8 and allow the circuit board 102 to send a pulse or otherwise illuminate light 104, signaling that the protrusion 6 and thus the alarm device 2 are activated. When the alarm device 2 is activated, and switch 106 is removed from the article (not shown), the process includes spring-loading switch 106 to the OFF position, thereby interrupting the power in path 8, resulting in alarm device 2 sounding the alarm 32. If so desired, the process can include having light 104 remain illuminated, rather than pulse as another form of alarm.

Yet another embodiment for protrusion 6 and housing 10, and thus extension 4, is illustrated in FIG. 14, which is a plug. Illustratively, the plug can be such as USB or MINI-USB plug, configuration. Cover 125 is shaped as a cover to a plug which can be made, for example, by plastic injection molding. Protrusion 6 includes an upper metal shell 112, connected to one of branch of path 8, such as Copper branch 73, and a lower metal shell 114, connected to another branch of path 8, such as Iron branch 75, assembled such that the circuit for path 8 is completed when the plug shells 112 and 114 are inserted in an electrical article (e.g., computer, cellular phone, etc.), apparatus, or other such object. In some cases, conductivity of a female portion (not shown) can complete the flow of electricity in path 8. In other cases, electrical flow from or via the article or apparatus that is to be protected is what is detected by alarm device 2. Depending on the implementation, a resistor 116 and light 118 can be used to signal that the alarm device 2 is active. FIG. 14, like FIG. 13, illustrates that key 80 need not always be connected to extension 4—in contrast to the embodiment shown in FIGS. 1, 9, etc.

Used in a process, there can be a detecting, by alarm device 2, for a change in electrical state, as discussed above. In the instant embodiment, when the plug shells 112 and 114 are removed from the article being protected, the process includes interrupting the power in the path 8, thereby causing the alarm device 2 to trigger the alarm 32.

From another point of view, an alarm apparatus can include a key 80, an extension 4 including a path 8 which provides electrical conductivity adjacent to the key 80, and an alarm device 2. The alarm device 2 can include a portal 18 located and structured to guide the key 80 to dispose a first switch 16 from OFF to ON. Also included is a second switch 22, in some but not all cases, operable by a plunger having an extended position and a retracted position, the extended position reaching farther outwards from an exterior surface 64 of the alarm device 2 than the retracted position. Additionally included is a third switch 26, in some but not all cases operable by receipt of broadcast of energy. Further included is an alarm 32 and circuitry 14 which can include a circuit board 14 having a structure that unites cooperation of the first switch 16, the second switch 22, the third switch 26, and the alarm 32. In some but not all embodiments, the united cooperation can be such that the alarm device 2 is activated when the first switch 16 is ON and the second switch is in the retracted ON position, the alarm device 2 alarm 32 is triggered when the circuitry 14 etc. detects an electrical change in the path 8, or when the plunger of the second switch is located in the extended OFF position. The alarm device 2 is deactivated by the receipt of the energy by the third switch 26 or by location of the first switch 16 to OFF.

If so desired, the alarm apparatus can further include a housing 10 in contact with the path 8. For example, the housing 10 can include a threaded hole such as nut 74 into which a screw 72 is positionable to adjustably position the contact of the path 8 partially encased in the housing 10. And in some implementations, the housing 10 has lock 78 structured to releasably attach to the key 80 portion of protrusion 6. The contact with the path 8 can be such that when the key 80 is attached to the housing 10, the path 8 and the housing 10 prescribe an opening into which an article, apparatus, or object can be secured for protection by the alarm apparatus. In some cases, there can be a lock 78 structured to releasably attach the key 80 to the housing 10, and the lock 78 can release the key 80 in response to a magnetic field. For example, a magnet 123 can be configured as a magnetic key for lock 78, and the magnet 76 ban be within container 120, having a resealable portion, such as cap 122 which, are combinable to contain the magnetic field. When cap 122 or the like is removed to expose magnet 76 adjacent to the lock 78, the magnetic field of magnet 123 is sufficient to unlock the lock 78.

In some embodiments, the alarm device 2 includes a fourth switch 106, in communication with the alarm device 2, and in some cases, circuitry 14 includes a printed circuit board 104 on which the first switch 16 and the third switch 26 are mounted, and the printed circuit board is rotationally mounted to retractably extend the path 8, under spring tension, e.g., by pulley 56, with respect to the second switch 22.

If preferred in one embodiment or another, the third switch 26 can be a switchable responsive to remote control 12's broadcast energy, such as infrared energy. For example, if so desired, the remote control 12 for the third switch 24 can provide the broadcast of energy in an infrared code, such that only if the code is accepted by third switch 26 does the code constitute the receipt of the energy influencing the third switch 24 to turn OFF the alarm 32.

Embodiments may include at least one luminescent indicator 24, in communication with the circuitry 14, indicative of the first switch 16 being ON when the second switch 22 being in the retracted position, i.e., OFF.

Implementations can, but need not, be carried out so that deactivation of the alarm 32 further requires applying a magnetic field to an electrical interrupter version of lock 78 located at the housing 10 or farther on the path 8 from the alarm 32 than the key 80, with the interrupter being triggerable to produce the electrical change for detection by alarm device 2. Another manner of such an implementation is to have the electrical interrupter version include a USB plug or a MINIUSB plug (see, e.g., FIG. 14). Illustratively, disconnecting the USB plug or the MINIUSB plug from an electrical device causes the electrical change. Yet another manner of such an implementation can have an interrupter version include another switch 106, operable by a plunger having an extended position OFF and a retracted ON position, such that the electrical change is produced when the other switch 106 is in the extended position. In these manners of implementation, there can be a luminescent indicator 24, in communication with the circuitry 10, indicative of the first switch 16 being ON when the second switch 22 being in the retracted position.

The alarm device can further include at least two adhesive surfaces, one of the adhesive surfaces at exterior surface 66 and a second of the adhesive surfaces proximate to the other switch 106, each of the adhesive surfaces 66 and 106 disposing the respective switch 26 and 106 in the ON position until separation from an object secured thereby.

The foregoing description of illustrated embodiments, including what is described in the Abstract are not intended to be exhaustive or to be limiting to the precise forms disclosed herein. While specific embodiments and examples are prophetically described herein for teaching-by-illustration purposes, various equivalent modifications should be recognized as possible within the spirit and scope of what is disclosed herein, as those skilled in the relevant art will recognize and appreciate. These modifications may be made in light of the foregoing description of illustrated embodiments and are to be included within the true spirit and scope of the disclosure.

Accordingly, appreciation is requested for the robust range of possibilities flowing from the core teaching herein. More broadly, however, the terms and expressions which have been employed herein are used as terms of teaching and not of limitation, and there is no intention, in the use of such terms and expressions, of excluding equivalents of the features shown and described, or portions thereof, it being recognized that various modifications are possible within the scope of the embodiments contemplated and suggested herein. Further, various embodiments are as described and suggested herein. Although the disclosure herein has been described with reference to specific embodiments, the disclosures are intended to be illustrative and are not intended to be limiting. Various modifications and applications may occur to those skilled in the art without departing from the true spirit and scope defined herein.

Thus, although illustrative embodiments have been described in detail above, it is respectfully requested that appreciation be given for the modifications that can be made based on the exemplary embodiments, implementations, and variations, without materially departing from the novel teachings and advantages herein. As indicated herein, means-plus-function language is intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment fastening wooden parts, a nail and a screw may be equivalent structures.

We claim:

1. An alarm apparatus including:

a key;

an extension including a flexible line which provides a path of electrical conductivity;

an alarm device, electrically connected to the flexible line at an end of the flexible line distant from the key, the alarm device including:

a first switch a portal located and structured to guide the key to dispose the first switch from OFF to ON;

a second switch operable by a plunger having an extended position and a retracted position, the extended position reaching farther outwards from an exterior surface of the alarm device than the retracted position;

a third switch operable by receipt of broadcast of energy;

an alarm;

circuitry located to electrically communicate with the path, the circuitry having a structure which unites cooperation of the first switch, the second switch, the third switch, and the alarm, such that:

the alarm is activated when the first switch is ON and the second switch is in the retracted position, the alarm is triggered when a detector detects an electrical change in the path or when the plunger of the second switch is located in the extended position, and the alarm is deactivated by the receipt of the broadcast of energy by the third switch or by location of the first switch to OFF; and a housing, located on the flexible line between the key and the alarm device, the housing including a contact with the flexible line, the housing including a receptor structured to releasably attach the key such that when the key is attached to the receptor, the flexible line and the housing prescribe an opening.

2. The alarm apparatus of claim 1, wherein the extension includes the key and wherein the flexible line provides the path of electrical conductivity adjacent to the key.

3. The alarm apparatus of claim 1, wherein:

the receptor structured to releasably attach the key includes a lock which releases the key in response to a magnetic field.

4. The alarm apparatus of claim 3, further including a magnetic key for the lock, the magnetic key including a magnet within a container, the container having a resealable portion which is removable to allow the lock to be unlocked.

5. The alarm apparatus of claim 1, wherein:

the alarm device includes a fourth switch, in communication with the alarm, magnetically operable to enable the alarm to be deactivated.

6. The alarm apparatus of claim 5, wherein the circuitry includes a printed circuit board on which the first switch and the third switch, but not the portal, are mounted, the printed circuit board being rotationally mounted to retractably extend the flexible line, under spring tension, with respect to the second switch.

7. The alarm apparatus of claim 5, further including a luminescent indicator, in communication with the circuitry, indicative of the first switch being ON when the second switch is in the retracted position.

8. The alarm apparatus of claim 1, wherein the broadcast of energy is infrared energy.

9. The alarm apparatus of claim 1, wherein the housing is slidably locatable along the flexible line and includes a threaded hole into which a screw is positionable to adjustably position the contact with respect to the flexible line.

10. The alarm apparatus of claim 9, further including an electrical interrupter, located farther on the flexible line from the alarm than the key, the electrical interrupter being triggerable to produce the electrical change.

11. The alarm apparatus of claim 1, further including a remote control for the third switch, the remote control switchably providing the broadcast of energy in an infrared code, such that only if the infrared code is accepted does the infrared code constitute the receipt of the broadcast of energy by the third switch.

12. The alarm apparatus of claim 1, wherein deactivation of the alarm further requires applying a magnetic field to an electrical interrupter located at the housing.

13. The alarm apparatus of claim 1, further including an electrical interrupter, located farther on the flexible line from the alarm than the key, the electrical interrupter being triggerable to produce the electrical change.

14. The alarm apparatus of claim 13, wherein the broadcast of energy is infrared energy.

15. The alarm apparatus of claim 14, further including a remote control for the third switch, the remote control switchably providing the infrared energy in an infrared code, such that only if the infrared code is accepted does the infrared code constitute the receipt of the broadcast of energy by the third switch.

16. The alarm apparatus of claim 13, further comprising a luminescent indicator, in communication with the circuitry, indicative of the first switch being ON when the second switch is in the retracted position.

17. An article of manufacture including:

a key, an extension including a flexible line, the flexible line having a first end proximate the key and a second end, which provides a path of electrical conductivity adjacent to the key;

an alarm device, connected to the second end, including:

a portal located and structured to guide the key to dispose a first switch from OFF to ON, a second switch operable by a plunger having an extended position and a retracted position, the extended position reaching farther outwards from an exterior surface of the alarm device than the retracted position, a third switch operable by receipt of broadcast of energy, an alarm, and circuitry located to electrically communicate with the path, the circuitry having a structure which unites cooperation of the first switch, the second switch, the third switch, and the alarm, such that:

the alarm is activated when the first switch is ON and the second switch is in the retracted position, the alarm is triggered when a detector detects an electrical change in the path or when the plunger of the second switch is located in the extended position, and the alarm is deactivated by the receipt of the broadcast of energy by the third switch or by location of the first switch to OFF; and a housing, located on the flexible line between the key and the alarm device, the housing including a contact with the flexible line, the housing including a receptor structured to releasably attach the key such that when the key is attached to the receptor, the flexible line and the housing prescribe an opening.

18. A process of making an apparatus, the process including:

forming a combination operable by a key, the combination including:

an extension including a flexible line which provides a path of electrical conductivity adjacent to the key;

an alarm device, electrically connected to the flexible line and distant from the key including:

a portal located and structured to guide the key to dispose a first switch from OFF to ON, a second switch operable by a plunger having an extended position and a retracted position, the extended position reaching farther outwards from an exterior surface of the alarm device than the retracted position, a third switch operable by receipt of broadcast of energy, an alarm, and circuitry located to electrically communicate with the path, the circuitry having a structure which unites cooperation of the first switch, the second switch, the third switch, and the alarm, such that:

the alarm is activated when the first switch is ON and the second switch is in the retracted position, the alarm is triggered when a detector detects an electrical change in the path or when the plunger of the second switch is located in the extended position, and the alarm is deactivated by the receipt of the broadcast of energy by the third switch or by location of the first switch to OFF, a housing, located on the flexible line between the key and the alarm device, the housing including a contact with the flexible line, the housing including a receptor structured to releasably attach the key and the contact with the flexible line is such that when the key is attached to the receptor, the flexible line and the housing prescribe an opening.

19. A product produced by the process of claim 18.

20. A process of using an alarm apparatus, the process including:

providing electrical power to the alarm apparatus comprising:

a key, an extension including a flexible line, the flexible line comprising a first end proximate the key and a second end, the flexible line providing a path of electrical conductivity adjacent to the key;

an alarm device, electrically connected to the second end, including:

a portal located and structured to guide the key to dispose a first switch from OFF to ON, a second switch operable by a plunger having an extended position and a retracted position, the extended position reaching farther outwards from an exterior surface of the alarm device than the retracted position, a third switch operable by receipt of broadcast of energy, an alarm, and circuitry located to electrically communicate with the path, the circuitry having a structure which unites cooperation of the first switch, the second switch, the third switch, and the alarm, such that:

the alarm is activated when the first switch is ON and the second switch is in the retracted position, the alarm is triggered when a detector detects an electrical change in the path or when the plunger of the second switch is located in the extended position, and the alarm is deactivated by the receipt of the broadcast of energy by the third switch or by location of the first switch to OFF; and a housing located on the flexible line between the key and the alarm device, the housing including a contact with the flexible line, the housing including a receptor structured to releasably attach the key such that when the key is attached to the receptor, the flexible line and the housing form a loop securing an item thereby protected from theft.

* * * * *